United States Patent [19]

Johnson et al.

[11] Patent Number: 4,784,392

[45] Date of Patent: Nov. 15, 1988

[54] BLOCK PUZZLE

[76] Inventors: Clarence Johnson; Irene Johnson, both of 106 Meadow View Dr., R.R. 2, Box 49, Decorah, Iowa 52101

[21] Appl. No.: 95,097

[22] Filed: Sep. 8, 1987

[51] Int. Cl.[4] ..... A63F 9/12

[52] U.S. Cl. ..... 273/160

[58] Field of Search ..... 273/157 R, 160

[56] References Cited

U.S. PATENT DOCUMENTS 3,546,792 12/1970 Sherman ..... 273/160 X

OTHER PUBLICATIONS

"Polycubes" by William J. Masalski, *Mathematics Teacher,* Jan. 1977, p. 46, sheets 1-3 and solution sheet.

"The Soma Puzzle: Two Sets, Two Colors" by David M. Collison, J. *Recreational Mathematics,* vol. 11(4), 1978-1979, pp. 275-278.

*Primary Examiner*—Anton O. Oechsle

*Attorney, Agent, or Firm*—Zarley McKee, Thomte, Vorrhees & Sease

[57] ABSTRACT

The block puzzle of the present invention includes a first set of eight pieces comprising a straight piece an L-shaped piece, a square piece, a T-shaped piece, a Z-shaped piece, a center piece, a left-hand piece, and a right-hand piece. Each of the eight pieces comprise a combination of four cubic units, all of the cubic units being the same size. A second set of eight pieces identical to the first set can be combined with the first set, and the combined 16 pieces may be assembled into a plurality of configurations, all of which produce an overall cube having 64 of the cube units therein and having a length, width and height equal to four of the cube units. A modified form of the invention includes a set of 16 pieces which are flat and which include three straight pieces, three square pieces, three Z-shaped pieces, three L-shaped pieces, and four T-shaped pieces. Each of these 16 pieces are formed from four square flat units. The 16 pieces may be arranged to provide a two-dimensional square having 64 of the identically mentioned square units formed into an 8×8 square. Each of the different shaped pieces in both of the above configurations may be made of distinctive colors so that different color patterns may be obtained when the pieces are put together into different configurations.

2 Claims, 2 Drawing Sheets

BLOCK PUZZLE

BACKGROUND OF THE INVENTION

This invention relates to a block puzzle.

Different forms of block puzzles have been provided in the past. Examples of these block puzzles are shown in Thompson U.S. Pat. No. 3,638,949; Flanigen U.S. Pat. No. 3,771,795; Klopfenstein U.S. Pat. No. 4,189,151; Steven R. Shannon U.S. Pat. No. 4,210,333; Beaman U.S. Pat. No. 4,323,245; and Guenther U.S. Pat. No. 4,534,563. Thompson shows a series of disconnected cube groups formed into pieces which are capable of being assembled into an overall cube having a 3×3×3 configuration.

Klopfenstein shows a plurality of cubes which may be formed into an 8"×8" flat configuration, and which include a plurality of different colored surfaces which can be arranged into different patterns.

None of the above patents show a puzzle which can be combined into a 4×4×4 overall cube containing 64 smaller cube units. Also, none of the above patents show a puzzle comprising 16 pieces which can be formed into a plurality of configurations forming an 8×8 flat square, with each of the individual pieces being formed from various arrangements of four smaller square units.

Therefore, a primary object of the present invention is the provision of an improved block puzzle comprising a number of different pieces, each piece being a different arrangement of a group of four cubic units.

A further object of the present invention is the provision of an improved puzzle which includes the aforementioned pieces which are capable of being assembled into a 4×4×4 cube.

A further object of the present invention is the provision of a modified form of the present invention which can be formed into an 8×8 two-dimensional square.

A further object of the present invention is the provision of a puzzle having a plurality of pieces, each of which is a different color, so that the different pieces can be combined into different configurations having different colored appearances.

A further object of the present invention is the provision of a block puzzle which is attractive in appearance, economical to manufacture, and durable in use.

SUMMARY OF THE INVENTION

The present invention relates to a block puzzle comprising a number of different shaped pieces. Each piece is formed from a different arrangement of four cubic units fastened together to form the different shapes. One form of the puzzle utilizes two sets of eight pieces. The eight pieces include a straight piece, an L-shaped piece, a square piece, a T-shaped piece, a Z-shaped piece, a center piece, a left-handed piece and a right-handed piece. Two sets of these eight pieces can be arranged to form a cube having four of the cubic units on each side in a 4×4×4 arrangement.

A modified form of the invention includes 16 flat pieces, each comprised of four flat square units. The 16 pieces comprise three straight pieces, three square pieces, three Z-shaped pieces, three L-shaped pieces, and four T-shaped pieces. These 16 pieces may be arranged in an overall square having eight of the square units on each side in an 8×8 configuration. They may be arranged in a plurality of different patterns to form this 8×8 square. Each of the different shaped pieces can be colored a unique color so that different color patterns may be achieved when they are assembled into the 8×8 configurations.

DETAILED DESCRIPTION OF THE PREFERRED EMBODIMENT

Figure 1:
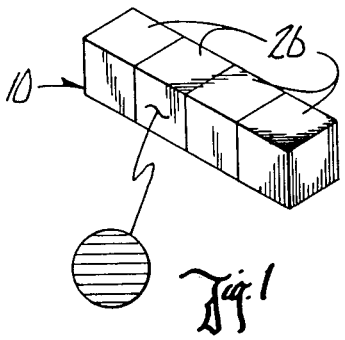
FIGS. 1–8 are perspective views of each of the individual pieces of the present puzzle.
Figure 2:
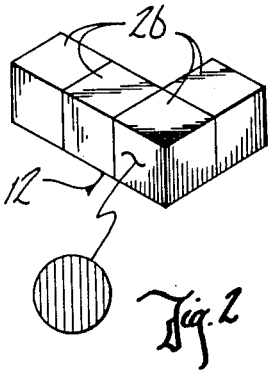
Figure 3:
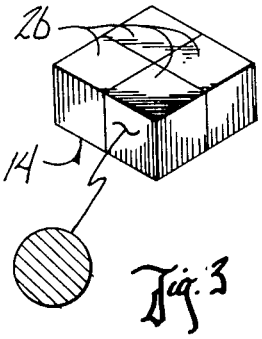
Figure 4:
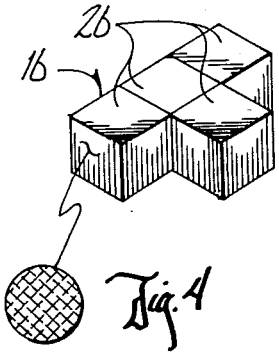
Figure 5:
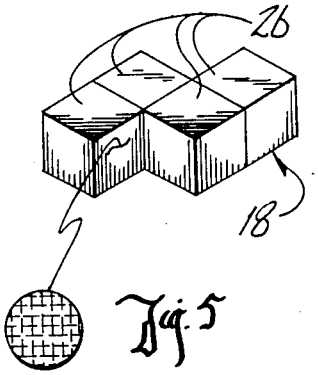
Figure 6:
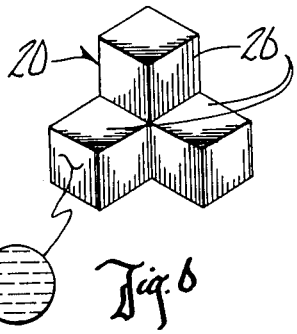

FIGS. 1–8 show the various pieces which form the block puzzle of the present invention. These pieces include a straight piece 10, an L-shaped piece 12, a square piece 14, a T-shaped piece 16, a Z-shaped piece 18, a center piece 20, a left-hand piece 22, and a right-hand piece 24. Each of the pieces 10–24 is comprised of four sub-units or cube units which are designated by the numeral 26 in the drawings. Each of these cube units is the same size and is used to form the various shapes of the pieces 10–24 shown in FIGS. 1–8. For example, straight piece 10 comprises four cube units 26 arranged in a straight line. L-shaped piece 12 comprises four cube units 26 arranged in an L-shape. Square piece 14 comprises four cube units 26 arranged in a square. T-shaped piece 16 comprises four cube units 26 arranged in a T-shaped configuration. Z-shaped piece 18 comprises four cube units arranged in a Z-shaped configuration.

Center piece 20 comprises four cube units 26, with one cube unit forming a corner and with the other three cube units extending at right angles to one another from three of the sides of the corner cube unit.

Figure 7:
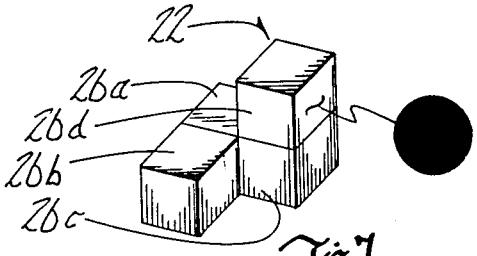
Figure 8:
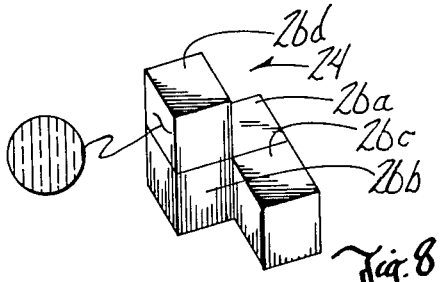

The left-hand piece shown in FIG. 7 comprises a corner cube unit **26*a* having two additional units, 26*b*, 26*c*, extending at right angles to one another from two adjacent sides of unit 26*a* and with a fourth unit 26*d* extending upwardly above unit 26*c*. The right-hand piece 24 shown in FIG. 8 includes a corner piece 26*a* having two pieces, 26*b*, 26*c*, arranged in the same configuration as 26*b* and 26*c* of FIG. 7. However, the fourth cubic unit, 26*d*, is arranged above piece 26*b*, as contrasted with being arranged above piece 26*c* shown in FIG. 7**.

Figure 9:
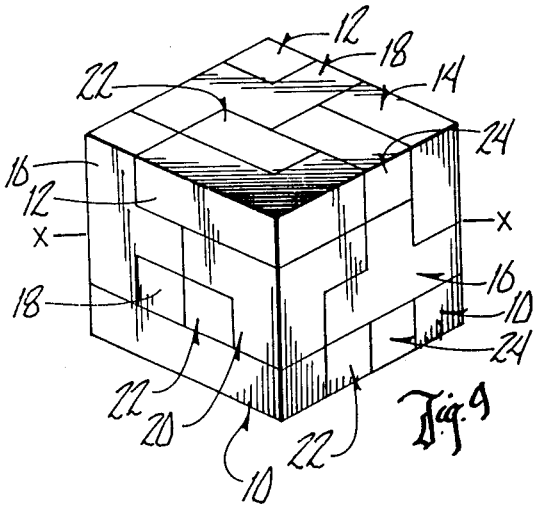
FIG. 9 is a perspective view of one cubic configuration which can be formed from two sets of the pieces shown in FIGS. 1–8.
Figure 10:
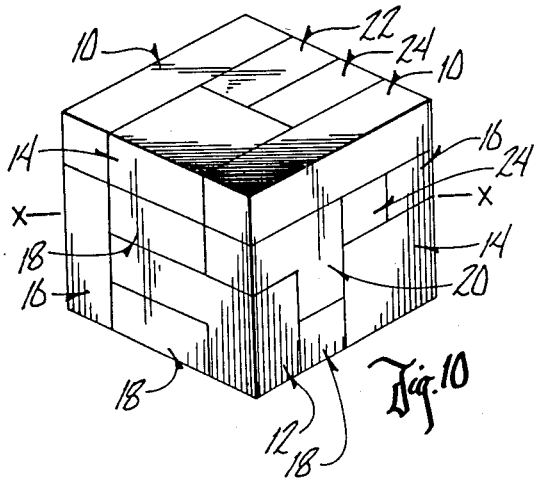
FIG. 10 is another view of the configuration of FIG. 9, shown rotated 180° about axis x-x.
Figure 11:
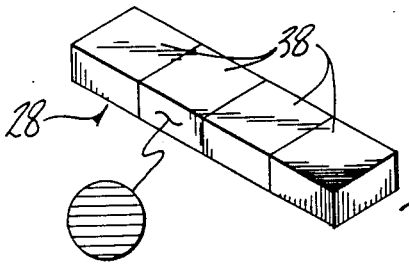
FIGS. 11–15 show five pieces which are utilized in a modified two-dimensional form of the present invention.
Figure 12:
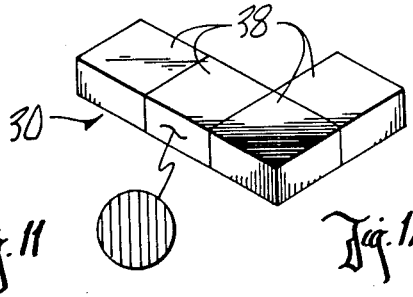
Figure 13:
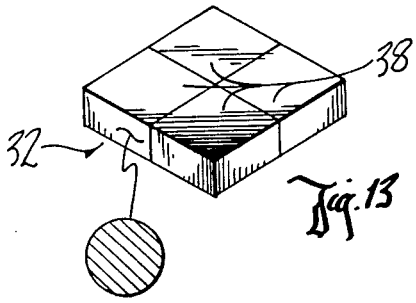
Figure 14:
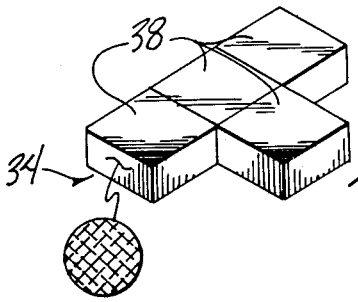
Figure 15:
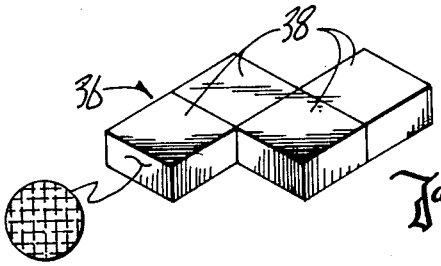

If two sets of the eight pieces shown in FIGS. 1–8 are combined, it is possible to create a plurality of overall cubes having dimensions of four cubic units x four cubic units. FIGS. 9 and 10 show one example of many cubic configurations which can be formed from two sets of the pieces shown in pieces 1–8. FIG. 9 shows a perspective view of the overall cube which can be formed from two sets of pieces shown in FIGS. 1–8. FIG. 10 shows the same cube rotated 180° about the axis designated by the letters x-x. The respective pieces 10–24 are labeled in the overall cube shown in FIGS. 9 and 10.

The cube shown in FIGS. 9–10 is one possible configuration, but a large variety of configurations may be formed into various 4×4×4 cubes. By making each of the pieces 10–24 different colors, it is possible to obtain different color configurations in the cube ultimately formed. Furthermore, the color combinations enable the user to visually analyze the patterns which he is achieving when forming different cube configurations. If the pieces were all the same color, it would be very difficult for the user to visually analyze the configuration he is building. Thus, the color codes for the various pieces are shown in FIGS. 1–8.

FIGS. 11–16 show a modified form of the invention for use in a two-dimensional puzzle. The configuration comprises five separate pieces which include a straight piece 28, an L-shaped piece 30, a square piece 32, a T-shaped piece 34, and a Z-shaped piece 36. Each of these pieces is formed from four small square units designated by the numeral 38. A set of 16 pieces is formed from the five different shaped pieces shown in FIGS. 11–15 and includes three each of the pieces 28, 30, 32, and 36, and four of the T-shaped pieces 34.

Figure 16:
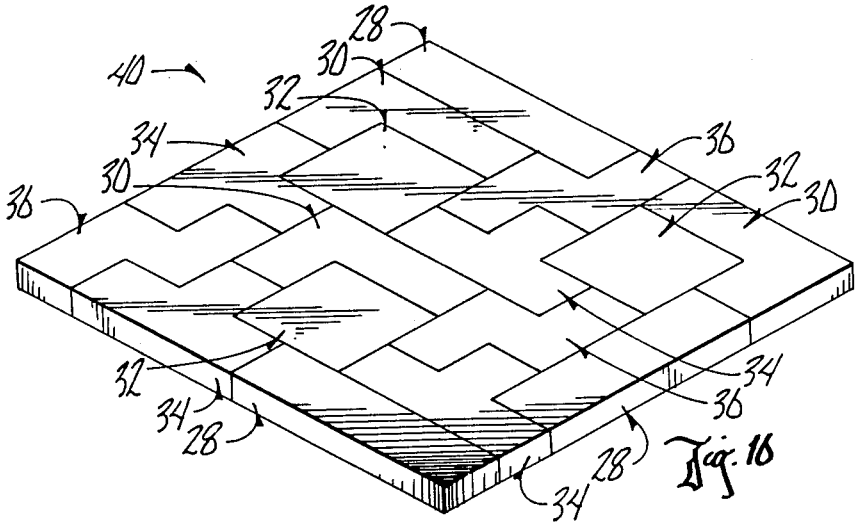
FIG. 16 shows an example of an 8×8 flat configuration which can be formed by a set of 16 pieces comprising three each of the pieces shown in FIGS. 11–13 and 15, and four each of the pieces shown in FIG. 14.

FIG. 16 shows an overall square 40 which is one of the many configurations which can be formed from the pieces 28–36. Each of the individual pieces is identified in the square 40, and square 40 has a dimension of 8×8, with eight individual squares 38 on each side. Each of the pieces 28–36 is colored a different color, and these colors can be arranged to provide different types of puzzles or problems for the user. That is, all of the T-shaped pieces are of one color, all of the L-shaped pieces are of another color, all of the straight pieces are another color, and so on. The configuration shown in FIG. 16 shows one example of a configuration arranged in such a manner that none of the pieces having the same color are touching. No pieces having the same shape (or color) are touching one another in the configuration shown in 16. It is also possible to provide other types of combinations. For example, another combination is possible with all of the same shapes (or colors) touching. Numerous other configurations can be achieved, and this variety of possibilities is what makes the puzzle particularly interesting and intellectually stimulating.

Thus, it can be seen that the device accomplishes all of the stated objectives.

We claim:

1. A block puzzle comprising:

a first set of eight pieces, including a straight piece, an L-shaped piece, a square piece, a T-shaped piece, a Z-shaped piece, a center piece, a left-hand piece, and a right-hand piece;

said straight piece comprising four straight-piece cubic units connected together in a straight line;

said L-shaped piece comprising a combination of three L-piece cubic units in a straight line and one L-piece cubic unit extending perpendicularly from one end of said straight line;

said square piece comprising four square-piece cubic units arranged in a square;

said T-shaped piece comprising three T-piece cubic units arranged in a straight line and one T-piece cubic unit extending perpendicularly from the center of said straight line;

said Z-shaped piece comprising first and second Z-piece cubic units arranged in a straight line, a third Z-piece cubic unit extending from said first Z-piece cubic unit in a first direction perpendicular to said line formed by said first and second Z-piece cubic units, and a fourth Z-piece cubic unit extending from said second cubic unit in a direction opposite to said first direction;

said left-hand piece comprising first, second, and third left-hand-piece cubic units defining a plane and being arranged with said first and third cubic units extending from said second left-hand-piece cubic unit and being perpendicular to one another, a fourth left-hand-piece cubic unit connected to said first left-hand-piece cubic unit and extending perpendicularly upward from said plane;

said center piece comprising first, second, and third center-piece cubic units defining a plane arranged with said first and third center piece cubic-piece cubic units extending from said second center-piece cubic units and being perpendicular to one another, a fourth center-piece cubic unit connected to said second center-piece cubic unit and extending perpendicularly upward from said plane;

said right-hand piece comprising first, second, and third right-hand-piece cubic units defining a plane and being arranged with said first and third right-hand-piece cubic units extending from said second right-hand-piece cubic unit and extending perpendicularly upward from said plane;

all of said straight-piece cubic units, said L-piece cubic units, said square-piece cubic units, said T-piece cubic units, said Z-piece cubic units, said left-hand-piece cubic units, said center-piece cubic units, and said right-hand-piece cubic units being of the same size and shape;

a second set of eight pieces identical to said first set; said first and second sets of said eight pieces being assembled into an overall cube having 64 of said cube units therein and having a length, width and height equal to four of said cube units.

2. A block puzzle according to claim 1, wherein each one of said eight pieces within said first set is colored a unique and different color from the remaining pieces in said first set, and said second set is identical to said first set.

* * * * *